US005179821A

United States Patent [19]

Hiser

[11] Patent Number: 5,179,821

[45] Date of Patent: Jan. 19, 1993

[54] SADDLE SLICKER

[76] Inventor: Timothy D. Hiser, P.O. Box 314, South Fork, Colo. 81154

[21] Appl. No.: 645,747

[22] Filed: Jan. 25, 1991

[51] Int. Cl.[5] ..... B68C 1/00

[52] U.S. Cl. ..... 54/44.1

[58] Field of Search ..... 54/44, 46; 297/224, 297/225, 229

[56] References Cited

U.S. PATENT DOCUMENTS

| | | | |
|---|---|---|---|
| 426,934 | 4/1890 | Heffernan | 54/46 |
| 515,239 | 2/1894 | Leupold | 54/46 X |
| 536,538 | 3/1895 | McIntire . | |
| 1,164,480 | 12/1915 | Deffebach et al. . | |
| 1,820,104 | 8/1931 | Whaley | 297/224 |
| 1,853,742 | 4/1932 | Owen et al. . | |
| 2,671,499 | 3/1954 | Reavis et al. | 297/225 X |
| 4,478,453 | 10/1984 | Schutz | 297/219 |
| 4,838,610 | 6/1989 | Perrin | 297/225 |
| 4,946,221 | 8/1990 | Livingston | 297/224 X |

FOREIGN PATENT DOCUMENTS

| | | | |
|---|---|---|---|
| 2050136 | 1/1981 | United Kingdom | 54/44 |

*Primary Examiner*—Robert P. Swiatek
*Attorney, Agent, or Firm*—Dennis T. Griggs

[57] ABSTRACT

A protective cover for use with a riding saddle includes a flexible central panel having side panels depending from its respective opposite sides for enclosing the stirrup leathers of the riding saddle. The flexible central panel has a sleeve attached to a front portion for receiving a saddle horn. According to this arrangement, the cover adjusted about the saddle by a drawstring inserted therethrough a casing defined by a folded edge of the flexible central panel, which permits the protective cover to be fitted onto riding saddles of different sizes. In order to maintain a snug fit of the flexible central panel to the riding saddle, the flexible central panel also includes elastic webbing, allowing the protective cover to conform to the complex curvature of the saddle.

3 Claims, 2 Drawing Sheets

SADDLE SLICKER

FIELD OF THE INVENTION

This invention relates generally to riding saddle accessories, and in particular to a protective cover that is adapted to fit riding saddles of different sizes.

BACKGROUND OF THE INVENTION

Saddles for horseback riding are made of leather and tend to be expensive; consequently, protecting them from exposure to environmental conditions, such as rain, snow, sun and ice, is important. Furthermore, protecting the leather from dust is necessary to prevent the leather from drying out. Also, pests such as mice may gnaw on the leather thereby causing serious damage to the saddle. The nature of leather renders it vulnerable to rain, and tends to stretch when wet, resulting in a distortion of its shape. Furthermore, leather when wet tends to release an odor; moreover, wet leather tends to deteriorate and fray.

DESCRIPTION OF THE PRIOR ART

The known prior art includes covers for infant car seats, covers for bicycle saddles, seat covers and even a horse cover. The horse cover identified in U.S. Pat. No. 1,164,480 is a canopy or blanket that protects the horse from exposure to the environmental elements. Such canopy devices are not intended to be used in combination with a riding saddle. Furthermore, conventional covers, canopies and the like are not designed to conform to the complex curvature of a riding saddle.

OBJECTS OF THE INVENTION

The principal object of the present invention is to provide an improved weather cover for a riding saddle.

A related object of the invention is to provide an improved cover for use with a riding saddle which is closely conformable about the complex curvature of the saddle so that the cover can be used while a rider is mounted.

Yet another object of the invention is to provide a cover for a riding saddle to protect the saddle leather from exposure to rain, sleet, snow, sun, pests and dust.

Still another object of the invention is to provide an improved protective cover for use with riding saddles of different sizes.

SUMMARY OF THE INVENTION

The cover for use with a riding saddle of the present invention includes a flexible central panel having side panels depending from respective opposite sides of the flexible central panel which are adapted to enclose the stirrup leathers. In addition to the side panels, a sleeve attached to a front portion of the flexible central panel provides a pocket for receiving a saddle horn. Furthermore, the flexible central panel has a folded edge defining a casing, and the casing has a drawstring inserted therethrough to permit the flexible central panel to be fitted snugly about riding saddles of various sizes. Also, the flexible central panel has elastic webbing which maintains a snug fit of the flexible central panel about the complex curvature of the riding saddle.

BRIEF DESCRIPTION OF THE DRAWINGS

The foregoing objects, features, and advantages of the invention will be understood when the following detailed description is read with reference to the accompanying drawings, in which.

DETAILED DESCRIPTION OF THE PREFERRED EMBODIMENT

Figure 1:
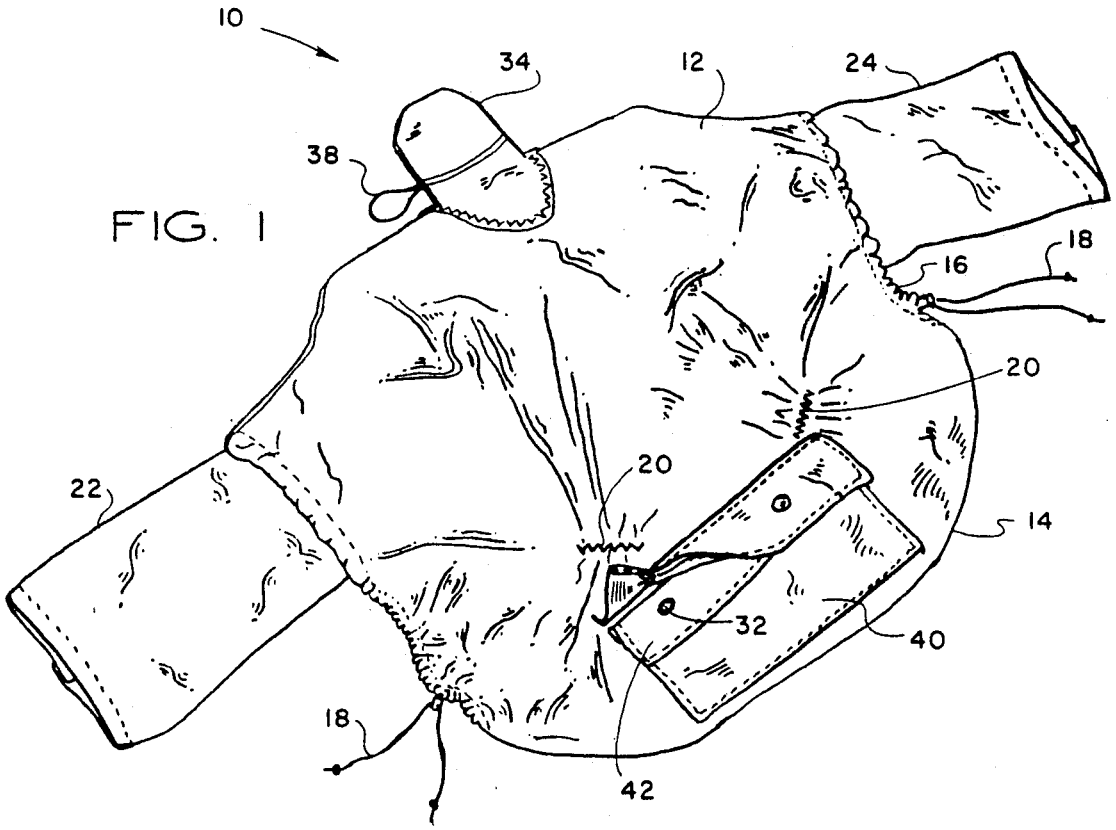
FIG. 1 is a top perspective view of the protective cover of the present invention.

In the description which follows, like parts are indicated throughout the specification and drawing with the same reference numerals, respectively. The drawings are not necessarily to scale, and certain parts have been exaggerated to better illustrate details of the present invention.

Referring to FIG. 1, the cover of the present invention, generally designated by the numeral 10, is shown in a perspective top-side view. The cover 10 includes a flexible central panel 12 having a forward panel portion being adapted to fold over and overlap the forward raised portion of a riding saddle when the central panel 12 is fitted onto the riding saddle. Central panel 12 has a folded edge 14 which defines a tubular casing 16 extending substantially along the entire perimeter of the flexible central panel 12. The casing 16 has a drawstring 18 inserted therethrough such that the flexible central panel 12 can be adjusted to conform to the complex curvature of riding saddles of various sizes. According to an alternative embodiment, an elastic band may be substituted for the drawstring and thereby provide the same fit adjustment.

Figure 2:
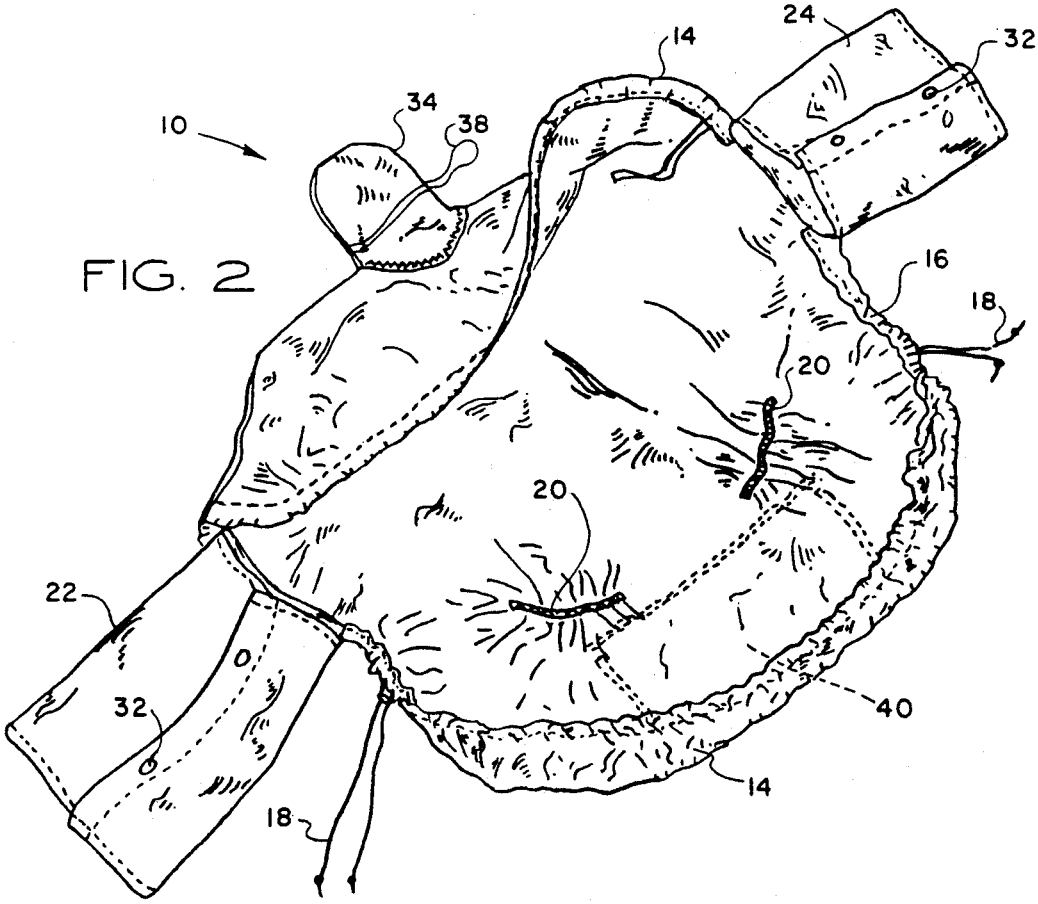
FIG. 2 is an underside perspective view thereof.

Further illustrated in FIG. 2 is a perspective view of the underside of the cover 10. Shown in FIG. 2, the flexible central panel 12 has gathered elastic webbing 20, which serves to maintain a snug fit of the flexible central panel 12 about the curved surfaces of the riding saddle.

Figure 3:
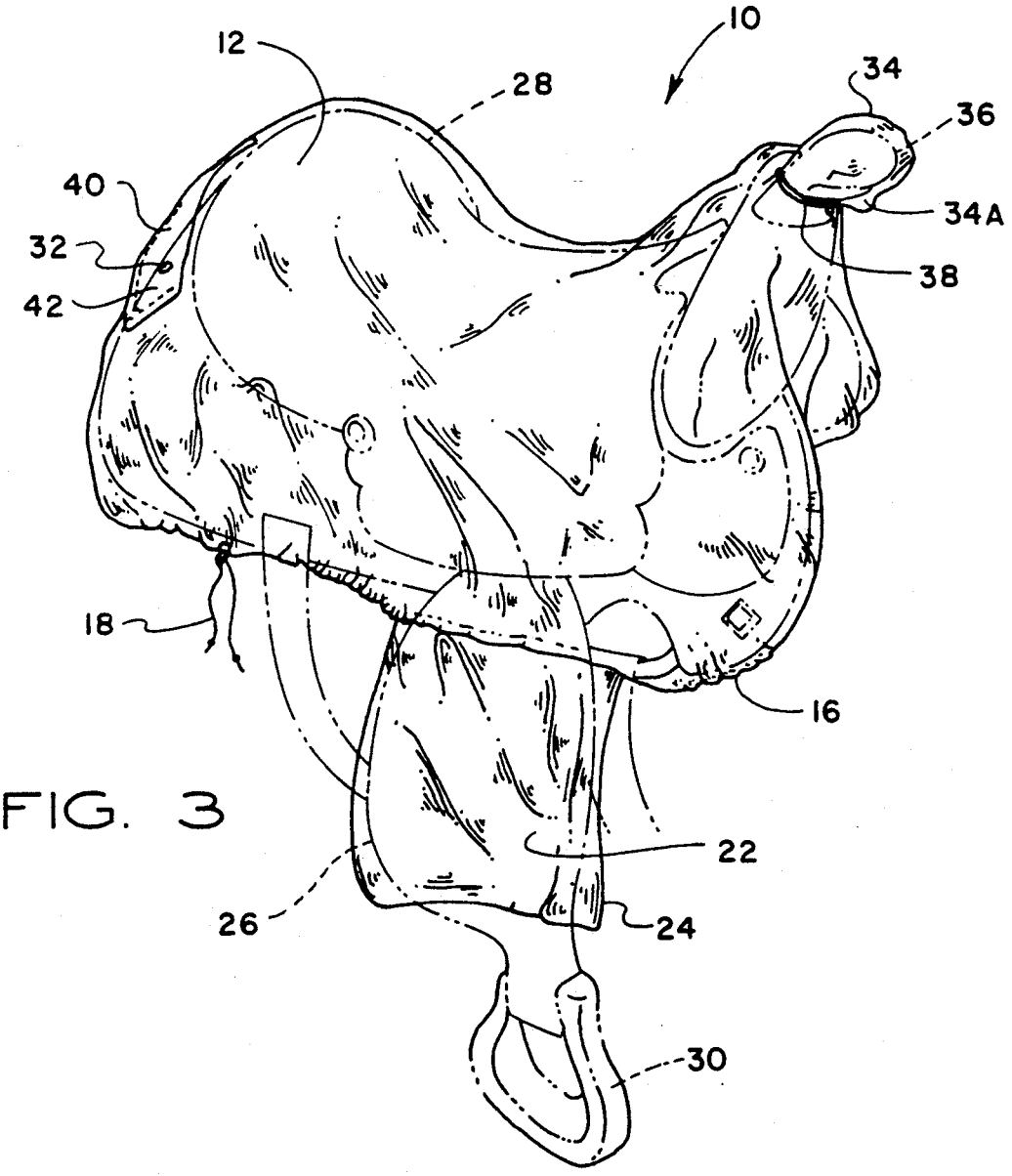
FIG. 3 is a perspective view of the protective cover of the present invention fitted about a riding saddle.

According to the preferred embodiment of the present invention, the flexible central panel 12 has side panels 22 and 24 depending from its respective opposite sides. The side panels 22 and 24 are adapted to cover the stirrup leather 26. As can best be seen in FIG. 3, the cover 10 of the present invention is in use with a riding saddle 28. The stirrup leather 26, shown in FIG. 3, is a strap used in connection with a riding saddle 28 to suspend a stirrup 30. The stirrup 30 includes a pair of small rings for receiving the foot of a rider, and are attached by the stirrup leathers 26 to the riding saddle 28. According to the preferred embodiment of the present invention, the side panels 22 and 24 shown in FIG. 2 illustrate the use of snap fasteners 32, which facilitate enclosure of the stirrup leather 26, and thus protect the stirrup leather 26 from exposure to adverse environmental conditions. The side panels 22 and 24 may be secured by other fasteners, for example a zipper, or VELCRO fastener.

The flexible central panel 12 further includes a sleeve 34. The sleeve 34 is attached to and projects from a front portion of the flexible central panel 12 and has a pocket 34A for receiving a saddle horn 36. FIG. 3 illustrates the cover 10 in use with the riding saddle 28. The saddle horn 36 is adapted to help a rider mount a horse, and also, to provide support to the rider.

The cover 10 of the preferred embodiment of the present invention has a cord 38 used to secure the sleeve 34 to the saddle horn 36. FIG. 1 shows the cord 38 attached to the sleeve 34 of the flexible central panel 12.

The cord is formed in a loop such that it can be stretched over the sleeve 34, which is adapted to receive the saddle horn 36.

According to another aspect of the present invention, the cover 10 has a storage pouch 40 attached to a rear portion of the flexible central panel 12. The pouch 40 may be opened and closed and is adapted for secure storage of small articles. The pouch 40 has a closure flap 42 which is fitted with snaps 32 for opening and closing the pouch 40. The cover 10 is preferably made from a waterproof material such as treated Nylon or the like in order to protect the riding saddle 28 from exposure to environmental conditions such as rain, sleet, snow, sun and ice.

In the preferred embodiment, the cover 10 fits snugly about the complex curvature of the saddle which allows the rider to mount and ride a horse with comfort while the cover 10 is secured about the riding saddle 28. In addition to the cover 10 being made of a waterproof material, the cover 10 preferably is fluorescent in color which enhances the visibility of the rider and horse to others.

While a preferred embodiment of the present invention has been shown and described herein, further modifications and improvements may be made by those skilled in the art. For example, the cover 10 of the present invention need not be used on a saddled horse, but can also function to protect a riding saddle while it is in storage. Moreover, the cover of the present invention can be used for protection of English riding saddles which do not have a saddle horn. That is, the cover can be fabricated without the saddle horn sleeve and provide full protection and riding comfort for such saddles. The foregoing disclosure and description of the invention are illustrated in explanation thereof, and various changes in size, shape and materials, as well as in the details of the illustrated construction may be made without departing from the spirit of the invention.

What is claimed is:

1. A protective cover for a riding saddle of the type having a saddle horn on a forward raised portion of said riding saddle, and stirrups depending from a side portion of said riding saddle, and stirrups being attached to said riding saddle by stirrup leathers, said protective cover comprising, in combination:

a flexible central panel member;

first and second side panel members depending from respective opposite sides of said flexible central panel member, said side panel members being adapted to cover said stirrup leathers;

said central panel member having a forward panel portion said forward panel portion being adapted to fold over and overlap the forward raised portion of a riding saddle when the central panel member is fitted onto the riding saddle; and, a saddle horn sleeve, said sleeve being attached to a front portion of said flexible central panel member and to an overlapping portion of the forward panel portion, said sleeve having a pocket for receiving a saddle horn.

2. A protective cover for a riding saddle of the type having a saddle horn projecting from a front portion of said riding saddle, and stirrups depending from opposite side portions of said riding saddle, said stirrups being attached to said riding saddle by stirrup leathers, said protective cover comprising, in combination:

a flexible central panel;

first and second side panels depending from respective opposite side portions of said flexible central panel, said side panels being adapted to cover said stirrup leathers;

said side panels having mutually coacting snap fasteners, said snap fasteners being adapted to secure said side panels about said stirrup leathers; and, a saddle horn sleeve, said sleeve being attached to a front portion of said flexible central panel for receiving a saddle horn.

3. A protective cover for a riding saddle of the type having stirrups depending from opposite side portions of said riding saddle, said stirrups being attached to said riding saddle by stirrups leathers, said protective cover comprising:

a flexible central panel member having a folded edge defining a casing, said casing having a drawstring inserted therethrough for adjusting said flexible central panel member to the curvature of said riding saddle;

elastic webbing attached to said central panel member for maintaining a snug fit of said flexible central panel member about the curved surface of said riding saddle;

first and second side panel members depending from respective opposite sides of said flexible central panel, said side members being adapted to enclose said stirrup leathers; and, said central panel member having a forward panel portion said forward panel portion being adapted to fold over and overlap the forward edge of a riding saddle when the central panel member is fitted onto the riding saddle.

* * * * *